US007681855B1

(12) United States Patent
Cashman et al.

(10) Patent No.: US 7,681,855 B1
(45) Date of Patent: Mar. 23, 2010

(54) WEARABLE MUSIC HOLDER

(76) Inventors: James M. Cashman, 8155 Tennessee St., Charendon Hills, IL (US) 60527; Rosemarie C. W Cashman, 8155 Tennessee St., Charendon Hills, IL (US) 60527

( * ) Notice: Subject to any disclaimer, the term of this patent is extended or adjusted under 35 U.S.C. 154(b) by 335 days.

(21) Appl. No.: 11/804,936

(22) Filed: May 21, 2007

(51) Int. Cl.
*A47B 19/00* (2006.01)
*A47B 97/04* (2006.01)
*A45F 3/10* (2006.01)

(52) U.S. Cl. ..... 248/441.1; 224/201; 224/257; 224/265; 224/625; 248/447; 248/460; 84/421

(58) Field of Classification Search ..... 248/444.1, 248/443, 444, 447, 448, 454, 459–460, 465, 248/309.1; 84/421, 327, 453, 387; 224/257, 224/258, 265, 270, 600, 621, 191, 201, 910, 224/186, 188, 607, 615, 623, 625, 642; D3/204, D3/215

See application file for complete search history.

(56) References Cited

U.S. PATENT DOCUMENTS 372,496 A * 11/1887 Small ..... 248/444
607,496 A * 7/1898 Watson ..... 248/444
2,828,576 A 4/1958 Fismen
2,863,256 A 12/1958 Hegarty
3,125,825 A 3/1964 Gaudette
D245,897 S * 9/1977 Evans et al. ..... D9/602
4,634,032 A * 1/1987 LaFlame ..... 84/421
4,715,297 A * 12/1987 Lichter ..... 109/50
4,832,302 A * 5/1989 Anderson et al. ..... 248/443
5,186,375 A 2/1993 Plonk
D388,246 S * 12/1997 Patterson ..... D3/204
D427,765 S * 7/2000 Porter ..... D3/215
6,106,016 A 8/2000 Bette
6,202,973 B1 * 3/2001 Navarin et al. ..... 248/444
6,316,707 B1 * 11/2001 Glover, II ..... 84/387 A

* cited by examiner

*Primary Examiner*—Amy J Sterling
*Assistant Examiner*—Tan Le

(57) ABSTRACT

Wearable music holders provide a portable lyre. A collar having a curved portion and two collar side supports is joined to a brace having a brace crossmember and two brace side supports by threaded extensions inserted through collar adjustment holes and brace adjustment holes in the collar side supports and brace side supports, respectively. Wing nuts releasably secure the threaded extensions in place. A crossmember joins the threaded extensions and has the bottom edge of a lyre attached to its middle. A fur collar sleeve encircles the curved portion of the collar, and a fur brace sleeve encircles the brace crossmember. The brace crossmember is sinuous, and except for the sleeves, the wearable music holder is fabricated from aluminum bar stock. The collar's curved portion rests around the wearer's neck, and the brace crossmember rests against the wearer's abdomen in use.

1 Claim, 3 Drawing Sheets

WEARABLE MUSIC HOLDER

BACKGROUND OF THE INVENTION

1. Field of the Invention

The present invention relates to a wearable music holder for use in connection with sheet music holders. The wearable music holder has particular utility in connection with providing a portable lyre.

2. Description of the Prior Art

Wearable music holders are desirable for providing a portable lyre. Musicians frequently encounter occasions where conventional music stands are unsuitable because of their size and lack of mobility, such as marching in parades, riding on parade floats, or sitting in stadium bleachers. Conventional solutions to this problem include instrument-mounted or arm-mounted lyres. These have the disadvantage of increasing the amount of weight the performer's arm or arms must support, which may be impossible for those suffering from arthritis or other musculoskeletal ailments. They also have a tendency to slip in use, requiring frequent adjustment.

The use of adjustable book holders is known in the prior art. For example, U.S. Pat. No. 6,202,973 to Navarin et al. discloses an adjustable book holder. However, the Navarin et al. '973 patent does not fit around the wearer's neck, and has further drawbacks of requiring straps.

U.S. Pat. No. 4,832,302 to Anderson et al. discloses a guitar mounted music holder that holds and displays sheet music or other material adjacent an acoustic-type guitar or other musical instrument. However, the Anderson et al. '302 patent does not fit around the wearer's neck, and additionally does not function without a guitar.

Similarly, U.S. Pat. No. 6,106,016 to Bette discloses a chest mounted book holder that carries a field guide or other reading matter while hiking or observing nature. However, the Bette '016 patent does not fit around the wearer's neck, and has the further disadvantage of requiring straps.

In addition, U.S. Pat. No. 5,186,375 to Plonk discloses a body supported holder for electronic devices that is for use with hand-held computers used in the field of utility meter reading. However, the Plonk '375 patent does not have a brace, and also does not have a lyre.

Furthermore, U.S. Pat. No. 3,125,825 to Gaudette discloses a portable table that supports writing and reading material. However, the Gaudette '825 patent does not fit around the wearer's neck, and further lacks the ability to be worn without a belt.

U.S. Pat. No. 2,828,576 to Fismen discloses a music holder for marching bandsmen that supports music on the arm of a marching bandsman. However, the Fismen '576 patent does not fit around the wearer's neck, and has the additional deficiency of requiring a strap.

Lastly, U.S. Pat. No. 2,863,256 to Hegarty discloses a combined support and receptacle for books and the like that attaches to the body of a person. However, the Hegarty '256 patent does not fit around the wearer's neck, and has the additional deficiency of requiring straps.

While the above-described devices fulfill their respective, particular objectives and requirements, the aforementioned patents do not describe a wearable music holder that allows providing a portable lyre.

Therefore, a need exists for a new and improved wearable music holder that can be used for providing a portable lyre. In this regard, the present invention substantially fulfills this need. In this respect, the wearable music holder according to the present invention substantially departs from the conventional concepts and designs of the prior art, and in doing so provides an apparatus primarily developed for the purpose of providing a portable lyre.

SUMMARY OF THE INVENTION

In view of the foregoing disadvantages inherent in the known types of adjustable book holders now present in the prior art, the present invention provides an improved wearable music holder, and overcomes the above-mentioned disadvantages and drawbacks of the prior art. As such, the general purpose of the present invention, which will be described subsequently in greater detail, is to provide a new and improved wearable music holder which has all the advantages of the prior art mentioned heretofore and many novel features that result in a wearable music holder which is not anticipated, rendered obvious, suggested, or even implied by the prior art, either alone or in any combination thereof.

To attain this, the present invention essentially comprises a collar with the opposing ends of a brace attached to its opposing ends. A crossmember has its opposing ends attached to the opposing ends of both the brace and the collar. A lyre is connected by its bottom edge to the crossmember's middle.

There has thus been outlined, rather broadly, the more important features of the invention in order that the detailed description thereof that follows may be better understood and in order that the present contribution to the art may be better appreciated.

The invention may also include the collar's middle being curved. The crossmember's middle may be sinuous. The collar's opposing ends may define a plurality of collar adjustment holes. The brace's opposing ends may define a plurality of brace adjustment holes. There may be a collar sleeve encircling the collar's middle. There may be a brace sleeve encircling the brace's middle. The wearable music holder may be made of plastic, steel, aluminum, titanium, wood, or carbon fiber composite. There may be a plurality of threaded extensions with one of their opposing ends attached to each of the opposing ends of the crossmember. The threaded extensions may have one of their opposing ends opposite the crossmember inserted through the collar adjustment holes and the brace adjustment holes. The crossmember may be removably secured to the collar and the brace by a plurality of wing nuts threadedly attached to the threaded extensions. The collar sleeve and the brace sleeve may be made of plastic, rubber, cloth, or fur. The collar may have a curved portion and two collar side supports. The collar side supports may define a plurality of collar adjustment holes. The brace may have a brace crossmember and two brace side supports. The brace side supports may be releasably connected to the collar side supports. The brace side supports may define a plurality of brace adjustment holes. The crossmember may have opposing ends that terminate in threaded extensions. The threaded extensions may be inserted through one of the collar adjustment holes in each of the collar side supports and one of the brace adjustment holes in each of the brace side supports to releasably connect the collar to the brace. A collar sleeve may encircle the curved portion of the collar. A brace sleeve may encircle the brace crossmember. The brace crossmember may be sinuous. The curved portion of the collar may fit around a wearer's neck, and the brace crossmember may rest against a wearer's abdomen. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wearable music holder that has all of the advantages of the prior art adjustable book holders and none of the disadvantages.

It is another object of the present invention to provide a new and improved wearable music holder that may be easily and efficiently manufactured and marketed.

An even further object of the present invention is to provide a new and improved wearable music holder that has a low cost of manufacture with regard to both materials and labor, and which accordingly is then susceptible of low prices of sale to the consuming public, thereby making such wearable music holder economically available to the buying public.

Still another object of the present invention is to provide a new wearable music holder that provides in the apparatuses and methods of the prior art some of the advantages thereof, while simultaneously overcoming some of the disadvantages normally associated therewith.

Even still another object of the present invention is to provide a wearable music holder for providing a portable lyre. This allows the wearer to adjust the size of the wearable music holder.

Still yet another object of the present invention is to provide a wearable music holder for providing a portable lyre. This makes it possible to hold music when space is too limited for a conventional music stand.

An additional object of the present invention is to provide a wearable music holder for providing a portable lyre. This makes the wearable music holder comfortable to wear.

A further object of the present invention is to provide a wearable music holder for providing a portable lyre. This prevents the wearable music holder from shifting or slipping like armband-type lyres.

Lastly, it is an object of the present invention to provide a new and improved wearable music holder for providing a portable lyre.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
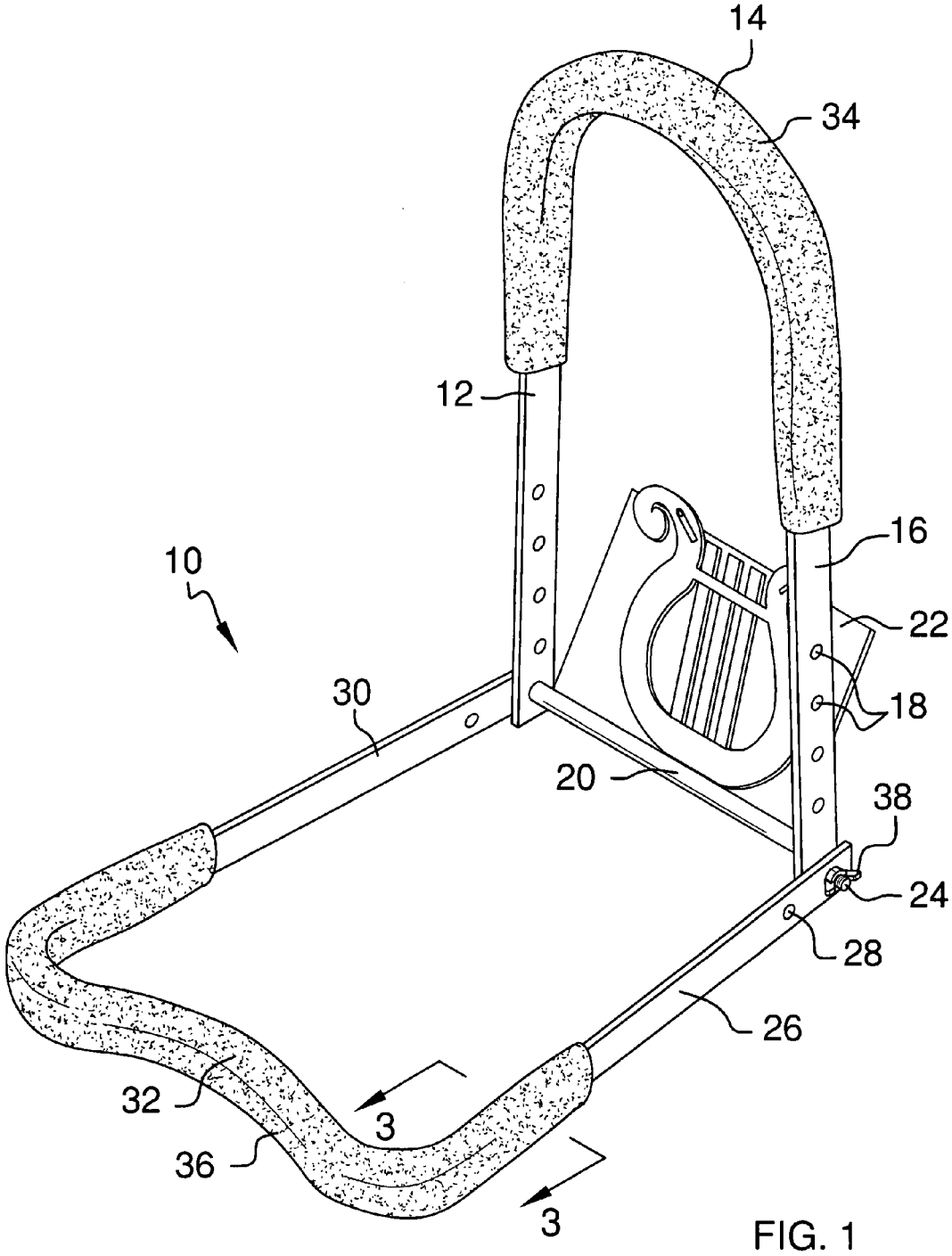
FIG. 1 is a top perspective view of the current embodiment of the wearable music holder constructed in accordance with the principles of the present invention.

Referring now to the drawings, and particularly to FIGS. 1-4, a current embodiment of the wearable music holder of the present invention is shown and generally designated by the reference numeral 10.

In FIG. 1, a new and improved wearable music holder 10 of the present invention for providing a portable lyre is illustrated and will be described. More particularly, the wearable music holder 10 has a collar 12 whose middle is a curved portion 14 and whose opposing ends are collar side supports 16. Each of the collar side supports 16 has a plurality of collar adjustment holes 18 in it. A brace 26 with brace crossmember 32 formed by its middle and whose opposing ends are brace side supports 30 has two brace adjustment holes 28 in each of its brace side supports 30. A crossmember 20 has opposing ends that terminate in threaded extensions 24. The threaded extensions 24 are inserted through one of the collar adjustment holes 18 and one of the brace adjustment holes 28 in each of the collar side supports 16 and brace side supports 30 to releasably attach collar 12 to brace 26. Wing nuts 38 releasably secure threaded extensions 24 in place. The bottom edge of lyre 22 is attached to crossmember 20's middle. The size of the wearable music holder 10 is adjustable based upon which of the brace adjustment holes 28 and collar adjustment holes 18 are connected by the threaded extensions 24. Curved portion 14 and brace crossmember 32 are covered by collar sleeve 34 and brace sleeve 36, respectively, to improve the user 42's comfort (illustrated in FIG. 4). In the current embodiment, collar 12 and brace 26 are 20 inches long, 14 inches wide, and 2 inches thick. With the exception of collar sleeve 34 and brace sleeve 36, which are made of fur in the current embodiment, the wearable music holder 10 is fabricated from aluminum bar stock in the current embodiment. In the current embodiment, curved portion 14 is curved to fit user 42's neck 40, and brace crossmember 32 is sinuous to rest against user 42's abdomen 44.

Figure 2:
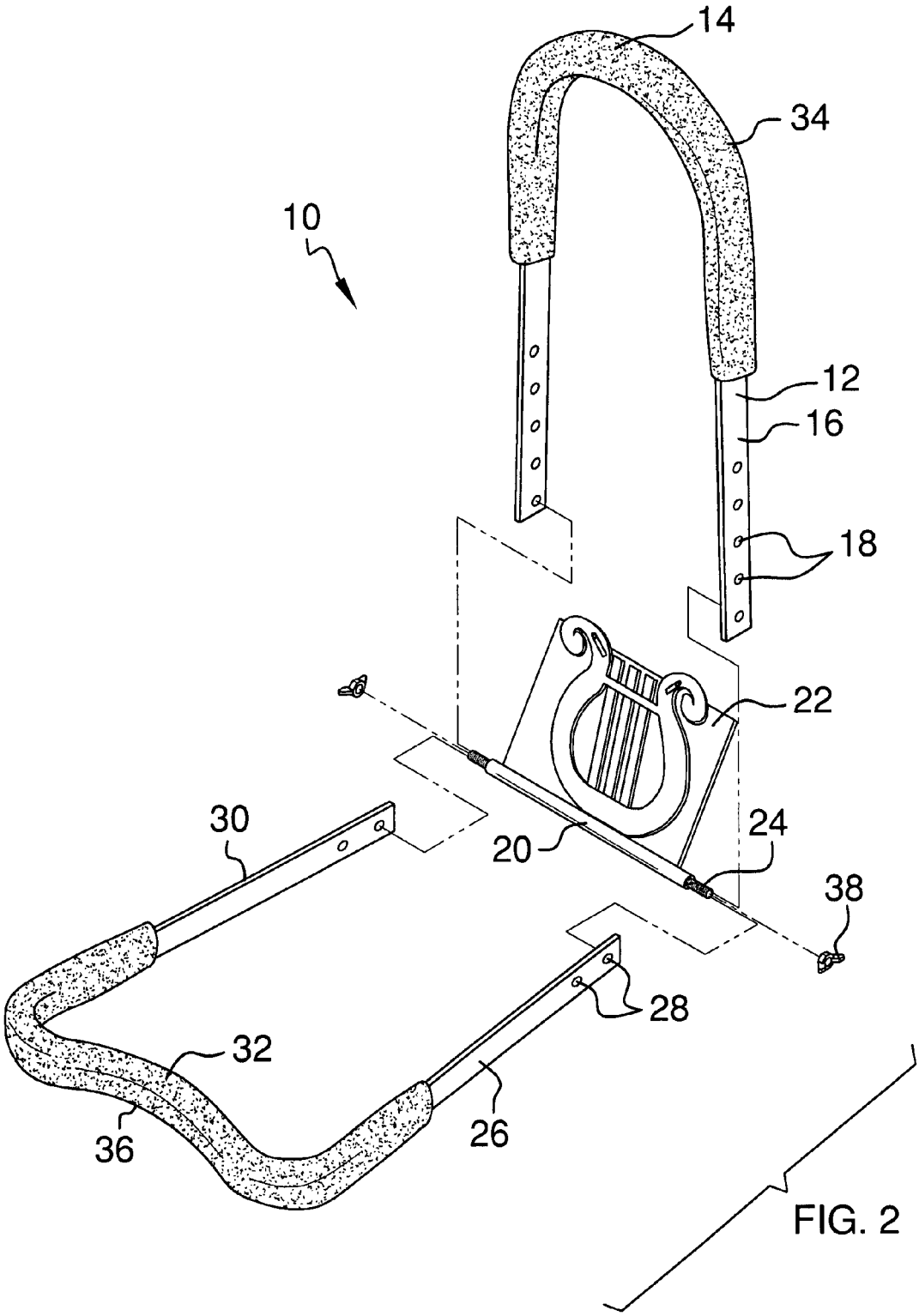
FIG. 2 is a top perspective exploded view of the wearable music holder of the present invention.

Moving on to FIG. 2, a new and improved wearable music holder 10 of the present invention for providing a portable lyre is illustrated and will be described. More particularly, the wearable music holder 10 has a crossmember 20 with threaded extensions 24. Threaded extensions 24 are inserted into collar adjustment holes 18 in collar side supports 16 and brace adjustment holes 28 in brace side supports 30 to adjust the size of wearable music holder 10. Wing nuts 38 releasably secure the threaded extensions 24 in place. Lyre 22, curved portion 14 with collar sleeve 34, and brace crossmember 32 with brace sleeve 36 are also shown.

Figure 3:
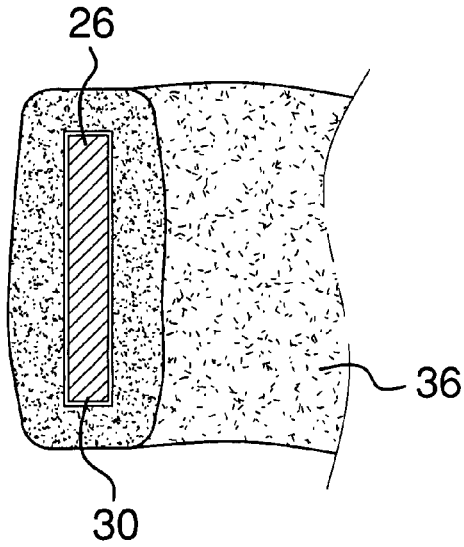
FIG. 3 is a side sectional view of the wearable music holder of the present invention.

Continuing with FIG. 3, a new and improved wearable music holder 10 of the present invention for providing a portable lyre is illustrated and will be described. More particularly, the wearable music holder 10 has a brace sleeve 36 that encircles brace side support 30 of brace 26. The collar sleeve 34 encircles the curved portion 14 of collar 12 in a similar fashion.

Figure 4:
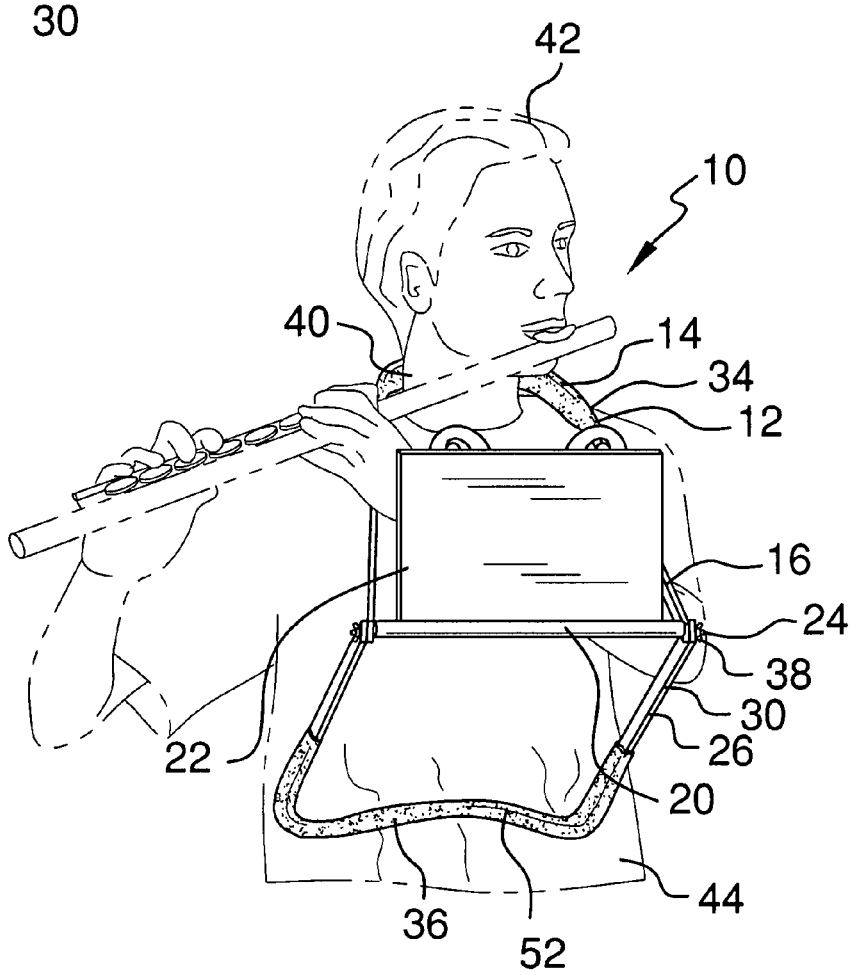
FIG. 4 is a bottom perspective view of the wearable music holder of the present invention.

Concluding with FIG. 4, a new and improved wearable music holder 10 of the present invention for providing a portable lyre is illustrated and will be described. More particularly, the wearable music holder 10 is shown in use with curved portion 14 of collar 12 fitting over user 42's neck 40 and brace crossmember 32 resting against user 42's abdomen 44. Lyre 22 is mounted on the middle of crossmember 20 and supports sheet music (not visible) in front of user 42. Wing nuts 38 secure threaded extensions 24 within collar side supports 16 and brace side supports 30. Collar sleeve 34 cushions user 42's neck 40, and brace sleeve 36 cushions user 42's abdomen 44. Note that user 42, neck 40, and abdomen 44 are for illustrative purposes only and are not part of the current invention.

In use, it can now be understood that the user 42 first connects crossmember 20 to collar 12 and brace 26 by inserting threaded extensions 24 through the desired collar adjustment holes 18 and brace adjustment holes 28. After securing threaded extensions 24 with wing nuts 38, user 42 places curved portion 14 of collar 12 around his or her neck 40 and positions brace crossmember 32 against his or her abdomen 44. Once the wearable music holder 10 is in the desired position, user 42 can secure his or her sheet music to lyre 22, lift his or her instrument, and begin playing. After performing, user 42 removes collar 12 from his or her neck 40 and can fold or completely disassemble wearable music holder 10 by loosening wing nuts 38 to the degree desired.

While a current embodiment of the wearable music holder has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy and light weight material such as plastic, steel, titanium, wood, or carbon fiber composite may be used instead of the aluminum bar stock described. Also, the fur sleeves may also be made of plastic, rubber, or cloth. And although providing a portable lyre has been described, it should be appreciated that the wearable music holder herein described is also suitable for supporting other materials adjacent to sheet music. Furthermore, a wide variety of securing devices may be used instead of the wing nuts described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A music holder wearing around a wearer's neck and resting against a wearer's abdomen, comprising:

a collar having a curved portion and two collar side supports, a brace having a sinuous brace cross member and two brace side supports, wherein said brace side supports are releasably connected to said collar side supports, and wherein said curved portion of said collar fits around a wearer's neck and said brace sinuous cross member rests against a wearer's abdomen;

a plurality of collar adjustment holes, wherein said collar side supports define holes therein to comprise said collar adjustment holes;

a plurality of brace adjustment holes, wherein said brace side supports define holes therein to comprise said brace adjustment holes;

a cross member having a middle and opposing ends that terminate in threaded extensions, wherein said threaded extensions are inserted through one of said collar adjustment holes in each of said collar side supports and one of said brace adjustment holes in each of said brace side supports to releasably connect said collar to said brace;

a plurality of wing nuts threadedly attached to said threaded extensions; and a lyre having a bottom edge with said bottom edge attached to said middle of said cross member.

* * * * *